US005960519A

United States Patent [19]

Thompson et al.

[11] Patent Number: 5,960,519

[45] Date of Patent: Oct. 5, 1999

[54] VEHICLE REAR LIFT GATE HINGE AND COUNTERBALANCE ASSEMBLY

[75] Inventors: Kevin O. Thompson, Monroe; Edward C. Sudduth, Livonia, both of Mich.

[73] Assignee: Midway Products Group, Inc., Monroe, Mich.

[21] Appl. No.: 09/047,611

[22] Filed: Mar. 25, 1998

[51] Int. Cl.[6] ..... E05F 1/08

[52] U.S. Cl. ..... 16/308; 49/386

[58] Field of Search ..... 16/289, 308, 306; 49/386, 364

[56] References Cited

U.S. PATENT DOCUMENTS

| | | | |
|---|---|---|---|
| Re. 32,878 | 2/1989 | Leonard . | |
| 2,799,891 | 7/1957 | Ragsdale | 16/308 |
| 2,947,025 | 8/1960 | Campbell et al. . | |
| 3,085,286 | 4/1963 | Whitehouse et al. | 16/308 |
| 3,339,969 | 9/1967 | Bridle et al. . | |
| 3,389,423 | 6/1968 | Johnson . | |
| 3,402,508 | 9/1968 | Kessler | 16/308 |
| 3,476,375 | 11/1969 | Brasseur | 16/308 |
| 3,498,207 | 3/1970 | Hazen . | |
| 4,291,501 | 9/1981 | Steinberg et al. . | |
| 4,949,426 | 8/1990 | Komaki . | |
| 5,297,314 | 3/1994 | Bender et al. | 16/270 |
| 5,358,301 | 10/1994 | Konchan et al. . | |
| 5,730,239 | 3/1998 | Holter | 49/386 |
| 5,758,389 | 6/1998 | Wolda | 16/308 |

*Primary Examiner*—Chuck Y. Mah
*Attorney, Agent, or Firm*—Brooke & Kushman P.C.

[57] ABSTRACT

A vehicle rear lift gate hinge and counterbalance assembly (22) includes a pair of laterally spaced hinges (24) and a counterbalance (25) including a torque rod (26) for pivotally supporting and counterbalancing a vehicle rear lift gate (18) for movement between open and closed positions with respect to a rear opening (14). Each hinge (24) includes a vehicle mounted hinge member (28) and a gate mounted hinge member (30) pivotally connected to each other. The torque rod (26) has a unitary construction including a central portion (38) ends (40) that include U-shaped bight portions (42) respectively received between laterally spaced portions (34) of one of the hinge members and engageable with an engagement portion (36) of the other hinge member to provide counterbalancing adjacent the closed position of the lift gate (18).

12 Claims, 2 Drawing Sheets

Fig. 1
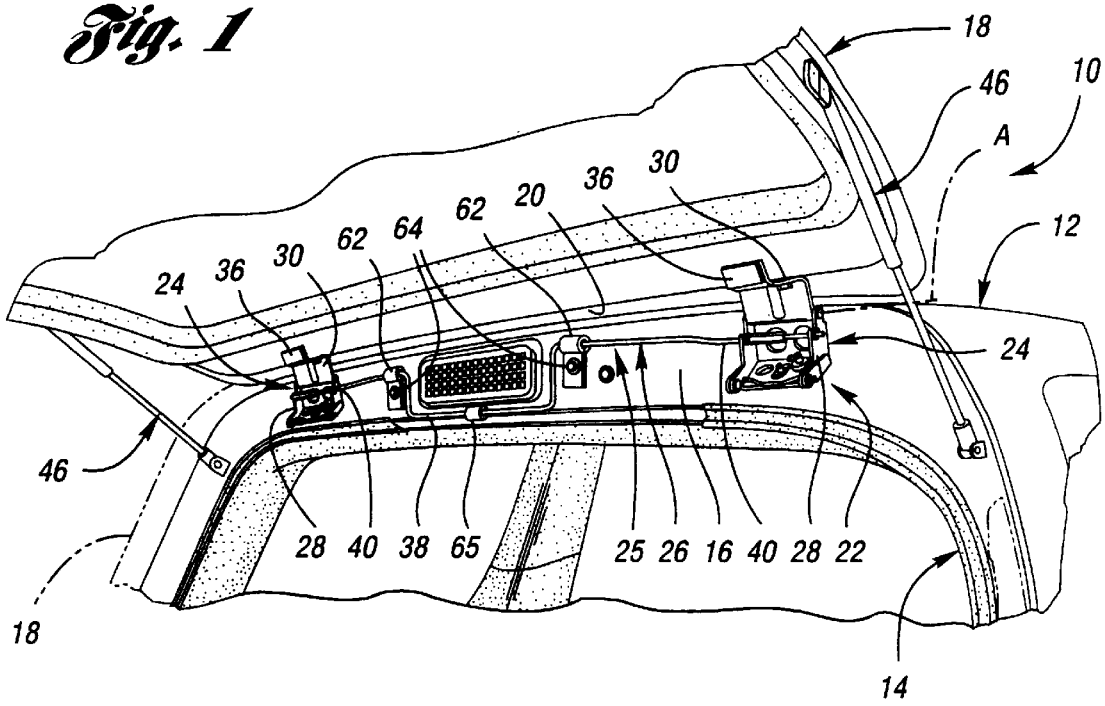
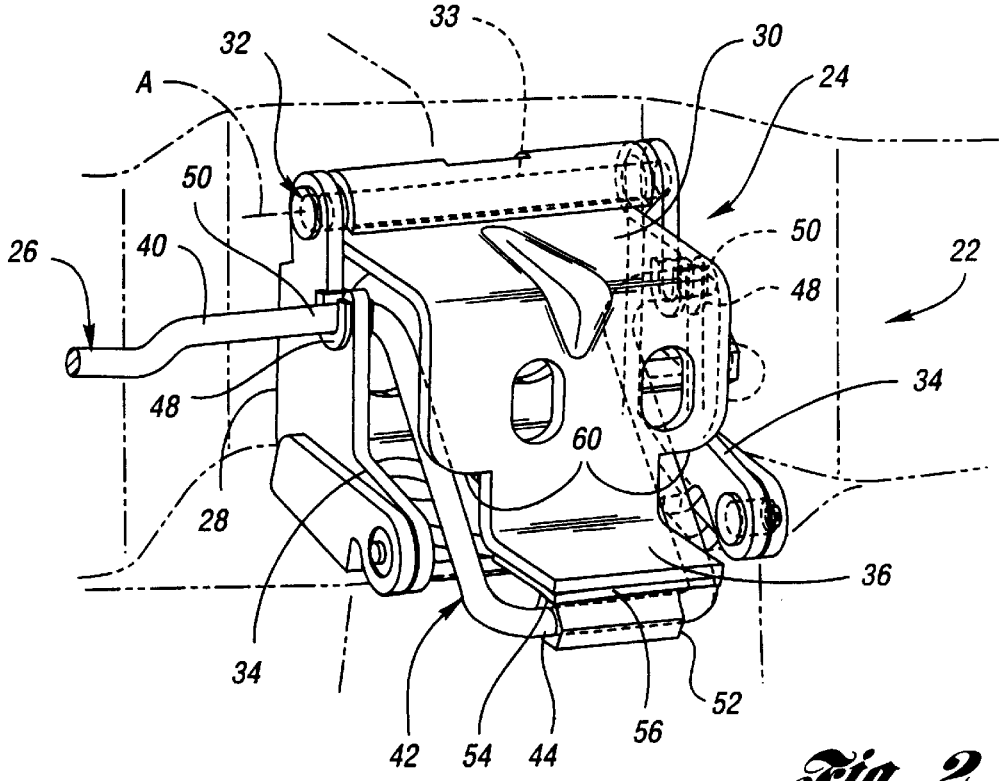
Fig. 2

VEHICLE REAR LIFT GATE HINGE AND COUNTERBALANCE ASSEMBLY

TECHNICAL FIELD

This invention relates to a hinge and counterbalance assembly for supporting and counterbalancing a vehicle rear lift gate at an upper edge portion thereof on a vehicle rear opening upper edge portion for movement about a pivotal axis between open and closed positions with respect to a rear opening of the associated vehicle.

BACKGROUND ART

Current production vehicles utilize hinges and gas springs for pivotally supporting and counterbalancing rear lift gates during movement between open and closed positions. Adjacent the closed position of the lift gate, the extending bias of the gas springs utilized to provide the counterbalancing does not always assist in the opening movement of the lift gate due to the positioning of the gas springs so as to be capable of providing sufficient counterbalancing in the open position where the counterbalancing torque required is much greater. The lack of any assist in the opening near the closed position is more of a problem with larger lift gates which is the tendency toward which lift gates are moving in current production vehicles.

Prior to the use of gas springs, vehicle closure members were previously counterbalanced by torque rods such as disclosed by U.S. Pat. Nos: 2,947,025 Campbell et al.; 3,339,969 Bridle et al.; 4,291,501 Steinberg et al.; and 5,358,301 Konchan et al. Other closure members that utilize torque rod counterbalancing are disclosed by U.S. Pat. Nos.: 3,389,423 Johnson; 3,498,207 Hazen; 4,949,426 Komaki; and Re. 32,878 Leonard.

DISCLOSURE OF INVENTION

An object of the present invention is to provide an improved hinge and counterbalance assembly for supporting and counterbalancing a vehicle rear lift gate at an upper edge portion thereof on a vehicle rear opening upper edge portion for movement about a pivotal axis between open and closed positions with respect to a rear opening of the associated vehicle.

In carrying out the above object, the hinge and counterbalance assembly includes a pair of hinges for mounting spaced laterally with respect to the vehicle to support the rear lift gate upper edge portion on the vehicle upper edge portion for movement of the lift gate between the open and closed positions. Each hinge includes a gate hinge member for mounting on the gate edge portion and also includes a vehicle hinge member for mounting on the vehicle edge portion as well as including a pivotal connection that pivotally connects the pair of hinge members thereof to each other to mount the lift gate for the pivotal movement about the pivotal axis between the open and closed positions. One hinge member of each hinge for mounting on one of the edge portions includes a pair of laterally spaced portions extending generally perpendicular to the pivotal axis. The other hinge member of each hinge for mounting on the other edge portion includes an engagement portion located between the laterally spaced portions of the associated hinge member that mounts on the one edge portion. A counterbalance torque rod of the assembly has a unitary construction including a central portion for mounting on the one edge portion and has a pair of torque rod ends that respectively extend from the central portion to the pair of hinges. Each end of the torque rod has a U-shaped bight portion that is located between the pair of laterally spaced portions of the one hinge member of the associated hinge. The U-shaped bight portion of each torque rod end has a closed end that engages the engagement portion of the associated other hinge member to provide counterbalancing of the lift gate adjacent the closed position.

In the preferred construction, the hinge and counterbalance assembly has the laterally spaced portions of the one hinge member of each hinge constructed to include torque rod end retainers, and the U-shaped bight portion of each torque rod end has an open end including mounting portions retained by the torque rod end retainers. These torque rod end retainers are most preferably constructed as hooks.

The hinge and counterbalance assembly is preferably used in cooperation with a pair of gas springs and the engagement portion of the other hinge member of each hinge disengages the closed end of the U-shaped bight portion of the associated torque rod end prior to movement to the open position.

In the preferred construction, the closed end of the U-shaped bight portion of each torque rod end includes an engagement member that engages the engagement portion of the other hinge member to provide the counterbalancing. This engagement member of the closed end of the U-shaped bight portion of each torque rod end in one construction has at least one flat engagement surface that engages the engagement portion of the other hinge member to provide the counterbalancing. In another construction, the engagement member of the closed end of the U-shaped bight portion of each torque rod end has a round engagement surface that engages the engagement portion of the other hinge member to provide the counterbalancing.

In the preferred construction of the hinge and counterbalance assembly, the torque rod central portion of the counterbalance has a laterally elongated U shape. The assembly further includes a pair of torque rod fasteners that provide securement thereof to the one edge portion on opposite lateral sides of and adjacent to the central portion of the torque rod. This mounting of the torque rod central portion of the counterbalance in the preferred construction is provided on the vehicle rear edge portion.

The objects, features, and advantages of the present invention are readily apparent from the following detailed description of the best modes for carrying out the invention when taken in connection with the accompanying drawings.

BRIEF DESCRIPTION OF DRAWINGS

FIG 1 is a partial perspective view illustrating a vehicle whose rear end includes a hinge and counterbalance assembly for supporting a rear lift gate in accordance with the present invention with the lift gate shown in a solid line indicated open position and a partially indicated phantom line represented closed position.

FIG. 2 is a perspective view illustrating a hinge of the assembly shown in a closed position.

BEST MODES FOR CARRYING OUT THE INVENTION

Figure 3:
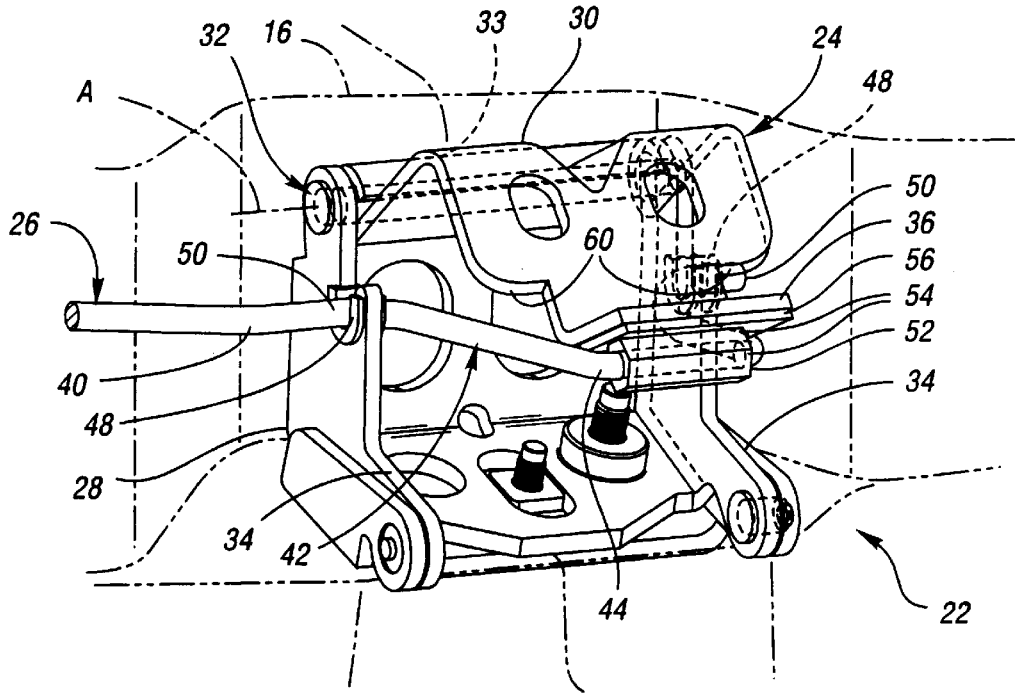
FIG. 3 is a perspective view similar to FIG. 2 but showing the hinge in a partially open position just before a flat engagement surface of a torque rod engagement member disengages an engagement portion of one of the hinge members as the hinge moves toward the open position.

With reference to FIG. 1, a vehicle generally indicated by 10 has a rear end 12 that includes a rear opening 14 whose upper extremity is defined by a rear upper edge portion 16. A rear lift gate 18 of the vehicle has an upper edge portion 20 that is supported on the vehicle upper edge portion 16 by a hinge and counterbalance assembly constructed in accordance with the present invention and collectively indicated by 22. This hinge and counterbalance assembly 22 includes a pair of hinges 24 spaced laterally with respect to the vehicle to support the lift gate 18 for movement about a pivotal axis A for movement between the open and closed positions. The hinge and counterbalance assembly 22 also includes a counterbalance 25 including a torque rod 26 that counterbalances the lift gate 18 adjacent the closed position as is hereinafter more fully described.

Each of the hinges 24 of the assembly 22 includes a vehicle hinge member 28 for mounting on the adjacent end of the vehicle edge portion 16 with securement thereto being provided in any conventional manner such as by conventional bolt fastening. Each hinge 24 also includes a gate hinge member 30 for mounting on the gate edge portion 20 at the adjacent end thereof with securement thereto also being provided in any suitable manner such as by conventional bolt fastening. A pivotal connection 32 of each hinge 24 includes a pin 33 that pivotally connects the hinge members 28 and 30 to each other to mount the lift gate for pivotal movement about the pivotal axis A between the open and closed positions. The vehicle hinge member 28, as illustrated in FIGS. 2 and 3, is mounted on the vehicle edge portion 16 and includes a pair of laterally spaced portions 34 extending generally perpendicular to the pivotal axis A. The gate hinge member 30 of each hinge is mounted on the adjacent end of the upper edge portion 20 of the gate and includes an engagement portion 36 located between the laterally spaced portions 34 of the vehicle hinge member 28 mounted on the vehicle edge portion 16.

As illustrated in FIG. 1, the counterbalance torque rod 26 has a central portion 38 that mounts on the vehicle edge portion 16 as is hereinafter more fully described. Torque rod 26 also has a pair of ends 40 that respectively extend to the pair of hinges 24 and are unitary with the torque rod central portion 38. Each end 40 of the torque rod 26 has a U-shaped bight portion 42 that is located between the pair of laterally spaced portions 34 of the vehicle hinge member 28 of the associated hinge. The U-shaped bight portion 42 of each torque rod end 40 has a closed end 44 that engages the engagement portion 36 of the gate hinge member 30 to provide counterbalancing of the lift gate 18 upon movement adjacent the closed position.

As illustrated in FIG. 1, a pair of gas springs 46 extend between the vehicle rear end 12 and the lift gate 18 to provide counterbalancing thereof adjacent the open position and during movement thereto from a partially open position. However, adjacent the closed position of the lift gate 18, the gas springs 46 do not provide any counterbalancing due to the positioning thereof in order to provide the counterbalancing operation in the open position where the downward torque of the lift gate 18 is greatest. Nevertheless, the hinge and counterbalance assembly 22 as described above provides counterbalancing adjacent the closed position so as to thereby facilitate opening movement of the gate in a manner that would not otherwise be possible.

As shown in FIGS. 2 and 3, the laterally spaced portions 34 of the vehicle hinge member 28 each include a torque rod end retainer 48. The U-shaped bight portion 42 of each torque rod end has an open end including mounting portions 50 retained by the torque rod end retainers 48 of the laterally spaced portions 34 of the associated vehicle hinge member 28. More specifically, the torque rod end retainers 48 are preferably constructed as hooks and have an upwardly opening shape that receives the torque rod mounting portions 50.

As previously mentioned, the hinge and torque rod assembly 22 is utilized in association with the pair of gas springs 46 to provide the counterbalancing. After movement of the lift gate 18 to a partially open position such as illustrated in FIG. 3, continued opening movement of the lift gate disengages the engagement portion 36 of the gate hinge member 30 of each hinge 24 from the closed end 44 of the U-shaped bight portion of the associated torque rod end 40. This disengagement thus takes place prior to movement of the gate to the fully open position of FIG. 1. Thus, after such partial opening of the lift gate, the entire counterbalancing is then provided by the gas springs 46 which are then in an orientation so their extending bias provides the counterbalancing without any assist from the torque rod 26. Nevertheless, the torque rod 26 provides counterbalancing adjacent the closed position of the lift gate 18 where the gas spring orientation does not provide the counterbalancing.

As illustrated in FIGS. 2 and 3, the closed end 44 of the U-shaped bight portion 42 of each torque rod end includes an engagement member 52 that engages the engagement portion 36 of the gate hinge member 30 to provide the counterbalancing. This engagement member 52 may be made from a suitable plastic such as nylon and as illustrated has at least one flat surface 54 for slidably engaging the engagement portion 36 of the gate hinge member 30. More specifically, the engagement member 54 may be injection molded from a suitable plastic with a somewhat tubular shape having a longitudinal slit that enables it to be placed over the torque rod closed end 44 and to also be able to rotate to provide continuous surface-to-surface sliding engagement with the engagement portion 36 of the gate hinge member 30. Furthermore, the engagement portion 36 may have a plastic slide member 56 secured thereto in any suitable manner such as by an adhesive to provide reduction in the friction and any noise due to the sliding engagement thereof with the engagement flat surface 54 of engagement member 52.

Figure 4:
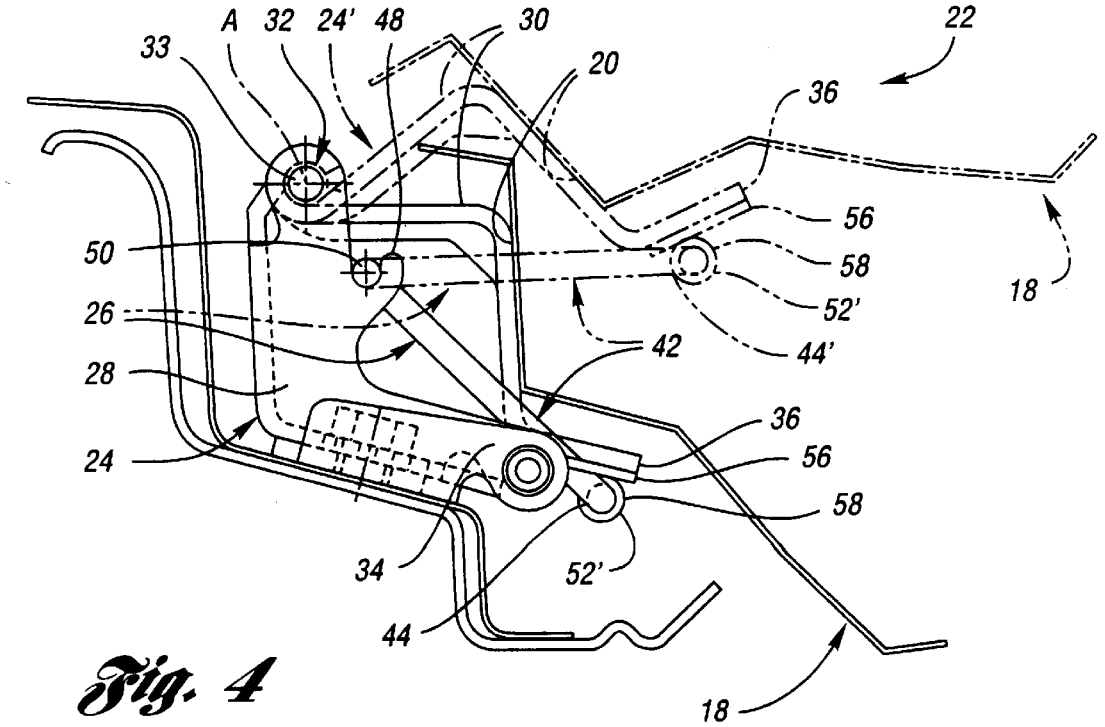
FIG. 4 is a side view of the hinge shown in a solid line indicated closed position and a phantom line indicated partially open position but with another construction of the torque rod engagement member which has a round engagement surface that engages the engagement portion of the one hinge member.

With reference to FIG. 4, another embodiment of the hinge 24' has the same construction as the previously described embodiment except as will be noted such that like components thereof are indicated by like reference numerals and much of the previous description is applicable and need not be repeated. However, in this embodiment of the hinge 24', the engagement member 52' has a round engagement surface 58 that engages the engagement portion 36 of the gate hinge member 30 with both sliding and rolling contact. This construction of the engagement member 52' permits injection molding thereof in situ on the closed end 44 of the U-shaped bight portion 42 of each torque rod end since there is no need to have any rotation thereof in the manner required with the previously described embodiment of FIGS. 2 and 3 where the engagement surface is flat.

As illustrated in FIG. 2, the engagement portion 36 of the gate hinge member 30 has a somewhat L shape that in the closed position is received within the closed end 42 of the U-shaped bight portion 42 of the associated torque rod end. In that connection, the gate hinge member 30 has shoulders 60 that extend from its overall lateral width to the L-shaped engagement portion 36, and the opposite sides of the U-shaped bight portion 42 extend adjacent the shoulders in the closed position between the closed end 44 and the mounting portions 50 of the U-shaped bight portion.

As illustrated in FIG. 1, a pair of torque rod fasteners 62 provide securement of the torque rod 26 to the vehicle edge portion 16 on opposite lateral sides of and adjacent to the central portion 38 of the torque rod, and these torque rod fasteners are secured in position in any suitable manner such as by conventional bolts 64. Also there is a torque rod fastener 65 securing the torque rod central portion 38. These torque rod fasteners 62 and 65 can be separate components as shown or integrated as portions of the vehicle.

During use, the central portion 38 of the torque rod pushes against the vehicle edge portion 16 when the torque rod provides the counterbalancing adjacent the closed position of the lift gate 18 as previously described. On the specific hinge illustrated, the torque rod counterbalancing operates during the first 40 degrees of opening movement. However, it should be appreciated that other degrees of opening movement can also be utilized in providing the torque rod counterbalancing and that some applications may also exist where the gas springs are not necessary and the torque rod provides the entirety of the counterbalancing of the associated lift gate. Likewise, it is preferable for the torque rod to be mounted on the vehicle edge portion, but there may be applications where it could be mounted on the gate edge portion.

While the best modes for carrying out the invention have been described in detail, those familiar with the art to which this invention relates will recognize various alternative designs and embodiments for practicing the invention as defined by the following claims.

What is claimed is:

1. A vehicle rear lift gate hinge and counterbalance assembly for supporting and counterbalancing a rear lift gate at an upper edge portion thereof on a vehicle rear opening upper edge portion for movement about a pivotal axis between open and closed positions with respect to a rear opening of a vehicle, the hinge and counterbalancing assembly comprising:

a pair of hinges for mounting spaced laterally with respect to the vehicle to support the rear gate upper edge portion on the vehicle upper edge portion for movement of the lift gate between the open and closed positions, each hinge including a gate hinge member for mounting on the gate edge portion and also including a vehicle hinge member for mounting on the vehicle edge portion as well as including a pivotal connection that pivotally connects the pair of hinge members thereof to each other to mount the lift gate for the pivotal movement about the pivotal axis between the open and closed positions, one hinge member of each hinge for mounting on one of the edge portions including a pair of laterally spaced portions extending generally perpendicular to the pivotal axis, and the other hinge member of each hinge for mounting on the other edge portion including an engagement portion located between the laterally spaced portions of the associated hinge member that is adapted to mount on said one edge portion; and a counterbalance torque rod of a unitary construction for mounting on said one edge portion and having a pair of torque rod ends that respectively extend to the pair of hinges, each torque rod end having a U-shaped bight portion that is located between the pair of laterally spaced portions of the one hinge member of the associated hinge, the U-shaped bight portion of each torque rod end having a closed end that engages the engagement portion of the associated other hinge member to provide counterbalancing of the lift gate upon movement from the closed position toward the open position, and the torque rod including a central portion for mounting on said one edge portion with the torque rod ends extending laterally therefrom with respect to the vehicle to the pair of hinges.

2. A vehicle rear lift gate hinge and counterbalance assembly as in claim 1 wherein the laterally spaced portions of the one hinge member of each hinge include torque rod end retainers, and the U-shaped bight portion of each torque rod end having an open end including mounting portions retained by the torque rod end retainers.

3. A vehicle rear lift gate hinge and counterbalance assembly as in claim 2 wherein the torque rod retainers comprise hooks.

4. A vehicle rear lift gate hinge and counterbalance assembly as in claim 1 wherein the engagement portion of the other hinge member of each hinge disengages the closed end of the U-shaped bight portion of the associated torque rod end prior to movement to the open position.

5. A vehicle rear lift gate hinge and counterbalance assembly as in claim 1 wherein the closed end of the U-shaped bight portion of each torque rod end includes an engagement member that engages the engagement portion of the other hinge member to provide the counterbalancing.

6. A vehicle rear lift gate hinge and counterbalance assembly as in claim 5 wherein the engagement member of the closed end of the U-shaped bight portion of each torque rod end has at least one flat engagement surface.

7. A vehicle rear lift gate hinge and counterbalance assembly as in claim 5 wherein the engagement member of the closed end of the U-shaped bight portion of each torque rod end has a round engagement surface.

8. A vehicle rear lift gate hinge and counterbalance assembly as in claim 1 wherein the central portion of the torque rod for mounting on said one edge portion has a laterally elongated U shape.

9. A vehicle rear lift gate hinge and counterbalance assembly as in claim 8 further comprising a pair of torque rod fasteners for providing torque rod securement to said one edge portion on opposite lateral sides of and adjacent to the central portion of the torque rod.

10. A vehicle rear lift gate hinge and counterbalance assembly as in claim 1 wherein the counterbalance torque rod is adapted to mount on the vehicle rear upper edge portion.

11. A vehicle rear lift gate hinge and counterbalance assembly for supporting and counterbalancing a rear lift gate at an upper edge portion thereof on a vehicle rear opening upper edge portion for movement about a pivotal axis between open and closed positions with respect to a rear opening of the vehicle in cooperation with counterbalancing provided by a pair of gas springs, the hinge and counterbalancing assembly comprising:

a pair of hinges for mounting spaced laterally with respect to the vehicle to support the rear gate upper edge portion on the vehicle upper edge portion for movement of the lift gate between the open and closed positions, each hinge including a gate hinge member for mounting on the gate edge portion and also including a vehicle hinge member for mounting on the vehicle edge portion as well as including a pivotal connection that pivotally connects the pair of hinge members thereof to each other to mount the lift gate for the pivotal movement about the pivotal axis between the open and closed positions, one hinge member of each hinge for mounting on one of the edge portions including a pair of laterally spaced portions extending generally perpendicular to the pivotal axis and including torque rod end retainers, and the other hinge member of each hinge for mounting on the other edge portion including an engagement portion located between the laterally spaced portions of the associated hinge member that is adapted to mount on said one edge portion; and a counterbalance torque rod of a unitary construction having a central portion for mounting on said one edge portion and also having a pair of ends that respectively extend to the pair of hinges, each end of the torque rod having a U-shaped bight portion that is located between the pair of laterally spaced portions of the one hinge member of the associated hinge, the U-shaped bight portion of each torque rod end having an open end including mounting portions mounted by the torque rod end retainers of the laterally spaced portions of the one hinge member of each hinge, the U-shaped bight portion of each torque rod end having a closed end that engages the engagement portion of the associated other hinge member to provide the counterbalancing of lift gate upon movement from the closed position toward the open position, and the U-shaped bight portion of each torque rod end disengaging the engagement portion of the associated other hinge member prior to movement of the lift gate to the open position.

12. A vehicle rear lift gate hinge and counterbalance assembly for supporting and counterbalancing a rear lift gate at an upper edge portion thereof on a vehicle rear opening upper edge portion for movement about a pivotal axis between open and closed positions with respect to a rear opening of the vehicle in cooperation with counterbalancing provided by a pair of gas springs, the hinge and counterbalancing assembly comprising:

a pair of hinges for mounting spaced laterally with respect to the vehicle to support the rear gate upper edge portion on the vehicle upper edge portion for movement of the lift gate between the open and closed positions, each hinge including a gate hinge member for mounting on the gate edge portion and also including a vehicle hinge member for mounting on the vehicle edge portion as well as including a pivotal connection that pivotally connects the pair of hinge members thereof to each other to mount the lift gate for the pivotal movement about the pivotal axis between the open and closed positions, the vehicle hinge member of each hinge including a pair of laterally spaced portions extending generally perpendicular to the pivotal axis and including torque rod end retainers, and the gate hinge member of each hinge including an engagement portion located between the laterally spaced portions of the associated gate hinge member; and a counterbalance torque rod of a unitary construction having a laterally elongated U-shaped central portion for mounting on the vehicle upper edge portion, the torque rod also having a pair of ends that respectively extend to the pair of hinges, each end of the torque rod having a U-shaped bight portion that is located between the pair of laterally spaced portions of the one hinge member of the associated hinge, the U-shaped bight portion of each torque rod end having an open end including mounting portions mounted by the torque rod end retainers of the laterally spaced portions of the one hinge member of each hinge, the U-shaped bight portion of each torque rod end having a closed end that engages the engagement portion of the associated gate hinge member to provide the counterbalancing of lift gate upon movement from the closed position toward the open position, and the closed end of the U-shaped bight portion of each torque rod end disengaging the engagement portion of the associated gate hinge member prior to movement of the lift gate to the open position.

* * * * *